US005310035A

United States Patent [19]

Dobransky, Jr. et al.

[11] Patent Number: 5,310,035

[45] Date of Patent: May 10, 1994

[54] PAPER AND COIN CURRENCY TOTALIZER FOR AN EXISTING VENDING MACHINE

[75] Inventors: Bernard J. Dobransky, Jr.; Raymond G. Stoken, both of Irwin, Pa.

[73] Assignee: Revenco Corporation, North Huntingdon, Pa.

[21] Appl. No.: 948,660

[22] Filed: Sep. 23, 1992

[51] Int. Cl.[5] ..... G07F 7/04

[52] U.S. Cl. ..... 194/206; 194/217

[58] Field of Search ..... 194/205, 206, 207, 211, 194/216, 217, 218, 350; 221/124, 127, 131, 133; 382/7

[56] References Cited

U.S. PATENT DOCUMENTS

| | | | |
|---|---|---|---|
| 2,292,628 | 8/1942 | Fry | 194/323 |
| 2,377,413 | 6/1945 | Fry | 194/227 |
| 2,935,170 | 5/1960 | Holstein et al. | 194/227 |
| 2,957,568 | 10/1960 | Gabrielsen | 194/227 |
| 2,972,400 | 2/1961 | Gabrielsen | 194/227 |
| 2,993,581 | 7/1961 | Holstein et al. | 194/227 |
| 3,028,940 | 4/1962 | Holstein et al. | 194/226 |
| 4,503,963 | 3/1985 | Steiner | 194/200 |
| 4,550,819 | 11/1985 | Smith | 194/218 |
| 4,669,596 | 6/1987 | Capers et al. | 194/217 X |
| 4,884,671 | 12/1989 | Gardellini | 194/207 |
| 5,036,966 | 8/1991 | Kasper et al. | 194/217 |
| 5,113,990 | 5/1992 | Grabrius et al. | 194/206 |

FOREIGN PATENT DOCUMENTS

| | | | |
|---|---|---|---|
| 0316892 | 12/1989 | Japan | 194/207 |
| 2186412 | 8/1987 | United Kingdom | 194/206 |

OTHER PUBLICATIONS

WBG Manufacturing, "The Dollars+Sense Solution", Jul. 1989 Vending Times.

Bill Collector AD-dated prior to 1991 (1 page).

National Vendors Coin Mechanisms Parts Manual--dated 1969-(cover & pp. 3-1 thru 3-11).

Ecko 635AD-dated prior to 1992 (2 pages).

National Venders Crown Line Manual-dated 1970 (cover & list of pages & 8 pages of introduction).

National Venders 22 Merchandiser Manual-dated 1980 (cover & 5 pages of introduction).

*Primary Examiner*—Michael S. Huppert

*Assistant Examiner*—Scott L. Lowe

*Attorney, Agent, or Firm*—James L. Sherman

[57] ABSTRACT

An improved paper and coin currency totalizer is installed on an existing vending machine and utilizes the existing coin receiving channels and the existing movable mechanical release mechanism and reset mechanism. An electronic coin sensor is installed in alignment with the coin receiving channel to produce a coin signal. A box is mounted on the vending machine and includes a paper currency sensor to produce a paper signal. A totalizer control circuit in the box accepts the coin signals and paper signals to determine when the proper amount of currency has been deposited to activate an actuation mechanism installed in the machine to move the release mechanism to the release position to allow a selection. After a selection is made, a reset sensor installed in the machine in alignment with the reset mechanism sends a reset signal to the totalizer control circuit to discontinue the actuation mechanism and to indicate no currency has been deposited. A method is provided to convert the mechanical totalizer in an existing vending machine to include the improved paper and coin currency totalizer.

15 Claims, 4 Drawing Sheets

PAPER AND COIN CURRENCY TOTALIZER FOR AN EXISTING VENDING MACHINE

BACKGROUND OF THE INVENTION

1. Field of Invention.

This invention relates to an improved paper and coin currency totalizer for being installed on an existing vending machine and to the method of converting an existing vending machine to enable paper currency and coin currency to be used to allow an item in the existing vending machine to be dispensed therefrom.

2. Description of the Prior Art.

There exists numerous types of vending machines for cigarettes, candy, snacks, soft drinks, etc. which include a wide array of electronic and mechanical means for facilitating the proper dispensing of the items therein. Recent innovations in coin or paper currency verification and totalization devices have been introduced into the vending machine field. A similar wide array of electronic dispensing mechanisms have been increasingly employed in various vending machines for the actual control of the dispensing of the items from such machines. While such improvements in both dispensing mechanisms and currency totalizers for such machines have resulted in an introduction of new, improved vending machines which could be utilized throughout the vending field, there remains an interest in older, and, in some cases, obsolete vending machines because of the cost of the newer machines as compared to a possible conversion of older, existing machines.

Historically, prior to the introduction of electronics to the vending machine field, most vending machines included mechanical coin currency totalizers and mechanical means for dispensing items therefrom. While there has clearly been a conversion from such mechanical totalizers and mechanical dispensing mechanisms in, for example, the soft drink vending field, mechanical totalizers and mechanical dispensing mechanisms for vending machines in the cigarette vending art have remained quite popular.

Although there are numerous electronically controlled cigarette vending machines with electronic currency totalizers, they tend to be quite expensive and require a significant investment to replace older, existing mechanical cigarette vending machines. In fact, if the cost of cigarettes were to have remained relatively low, it is questionable whether there would be any significant replacement of older mechanical cigarette vending machines by the newer electronic cigarette vending machines.

Some mechanical cigarette vending machines have proven to be quite reliable and relatively inexpensive to maintain. One type of vending machine which continues to be widely accepted in the cigarette vending field is produced by National Vendors of St. Louis, Mo. The basic mechanical dispensing mechanisms in the machines for physically dispensing the cigarettes were developed many years ago and have been sold and maintained, for example, under the names Crown Line, Series 800; Crown Line, Cabaret 800; Crown Elite 222; and Golden Cabaret 222 by National Vendors. Such cigarette vending machines typically include a coin receiving slot on the face thereof and employ a series of mechanical selection knobs. The selection knobs are respectively aligned with stacks of cigarette packs stored within the machine and are capable of being pulled to dispense a single pack after the proper amount of coin currency has been deposited in the slot. In order to control the mechanical dispensing mechanism, National Vendors, Inc. has provided such machines with various types of mechanical coin recorders or totalizer units. U.S. Pat. Nos. 2,935,170; 2,993,581; and 3,028,940, which were assigned to National Vendors, Inc. of St. Louis, Mo. disclose the evolution in the design of such mechanical dispensing mechanisms and such mechanical coin totalizer units for the control and operation of the mechanical cigarette vending machines.

The present invention is directed to the modification of one particular series of mechanical coin totalizer units, which have been provided by National Vendors, Inc., and are particularly adapted to be utilized in numerous existing vending machines which employ mechanical dispensing mechanisms. While the specific mechanical coin totalizer unit will be disclosed in detail in the Detailed Description of the Preferred Embodiment, it is significant to note that some of the features therein are specifically disclosed in U.S. Pat. Nos. 2,993,581 and 3,028,940.

U.S. Pat. No. 3,028,940, which is entitled "Coin Apparatus", discloses a comparable mechanical coin totalizer unit and how it is configured to cooperate with the typical mechanical dispensing mechanisms which have been widely accepted and utilized in the cigarette vending field. U.S. Pat. No. 3,028,940 includes specific references to U.S. Pat. No. 2,993,581, which is also entitled "Coin Apparatus" but discloses features of the mechanical dispensing mechanisms which have been widely accepted in the cigarette vending field and are well-known in the vending art. Significantly, both the devices shown in U.S. Pat. Nos. 2,993,581 and 3,028,940 include a series of three release means which provide a lockout means to prevent the dispensing of a pack of cigarettes if the proper amount of coin currency has not been deposited in the coin slot for passage through the mechanical coin totalizer unit. Upon movement of the release means to the release position after the proper amount of coin currency is provided, the last amount of pulling movement of the cigarette pack selection knob will physically dispense the selected pack of cigarettes. Specifically, three such release means have been provided because the cigarette vending machines were configured to include cigarette packs having three different prices to accommodate various types of cigarettes being sold during the early use of such machines.

The preferred machines disclosed in the above mentioned patents include mechanical coin totalizer units having the primary purpose of mechanically determining if the proper amount of coin currency has been deposited in the coin slot for the purchase of a pack of cigarettes. The coin totalizer unit not only includes means for mechanically totaling the coin currency deposited but also includes three separate means for being selectively adjusted for three different currency values, as mentioned above, to specifically allow a selected pack of cigarettes, depending on its particular value, to be dispensed.

The totalizer unit of U.S. Pat. No. 3,028,940 is mounted within the machine at an outside wall adjacent to the above mentioned release means. The mechanical totalizer unit includes vertical inside and outside plates which are spaced one from the other and parallel to the side wall of the machine. A coin chute assembly is mounted between the plates. The assembly includes a nickel chute, a dime chute and a quarter chute. The chutes have an elongated generally rectangular cross section corresponding to the size of coin currency to be passed therethrough and are located side-by-side in a flatwise parallel relation with the dime chute being located between the nickel and quarter chutes.

Each of the plates forming the walls of the chutes is slotted to provide an arcuate slot through the entire coin chute assembly. A portion of the arcuate slot registers with the nickel chute at the upper end thereof and has a length approximately one-fifth of the entire length of the arcuate slot. The arcuate slot registers with the dime chute from its upper end through a portion of the arcuate slot having a length approximately twice the length of the portion in the nickel chute. It also registers with the quarter chute through the entire length which is about five times the length of the portion of the arcuate slot for the nickel chute.

Although the coin chute assembly of the vending machines has chutes for nickels, dimes and quarters, it should be recognized that each coin directed to its respective chute will enter a coin selector and slug rejecter device mounted above the totalizer unit to deliver nickels to the nickel chute, dimes to the dime chute and quarters to the quarter chute. The coin selector and slug rejecter device is not specifically shown or described in U.S. Pat. No. 3,028,940. Such coin selector and slug rejecter devices are well known in the vending field and are outside of the scope of the invention as disclosed herein. Generally, the coin selector and slug rejecter device acts to reject coins of improper denominations, such as pennies, and other spurious coins. The rejected coins drop out of the device through a separate chute. Various coin selector and slug rejecter devices are suitable for use in both the prior art vending machines and the vending machine of the present invention, are well known and could include, for example, a device similar to that disclosed in U.S. Pat. No. 2,292,628.

The coin recorder mechanism of the totalizer unit includes a primary shaft which is journaled to the inside and outside plates of the unit. The center of the arcuate slot is at the axis of the primary shaft. The coin recorder mechanism is driven by a trip wire which is fixed to the shaft to produce rotation thereof. The end of the trip wire includes a finger which extends into the common arcuate slot to intersect and extend across each of the coin receiving chutes. Basically, the trip wire is biased to swing upward to a raised or retracted position prior to the insertion of each individual coin. The trip wire will be moved in a downward direction under the weight of each coin as it is deposited in its respective chute. The actual amount of movement of the trip wire, and thus the shaft to which it is attached, will depend on the particular denomination of coin deposited in the respective chutes.

Although it is clearly disclosed in U.S. Pat. No. 3,028,940, it is appropriate to understand that the particular amount of rotational movement of the wire and associated shaft produces a registered, rotational movement of a ratchet wheel which are mounted on the shaft within the interior of the coin recorder mechanism. Consequently, any coin whether a nickel, dime or quarter falling through its respective chute engages the finger on the trip wire and swings the wire downward against the biasing of the spring. A nickel falling in the nickel chute swings the wire down through the particular arc discussed hereinabove to a point where the finger passes out of the nickel chute and the nickel rides over the finger, continues to fall and exits from the lower end of the nickel chute. Similarly, a dime falling into the dime chute swings the wire downward through an arc which is twice as large as that for the nickel chute until the finger passes out of the dime chute and the dime rides off the finger, continues its fall and exits from the lower end of the dime chute. A quarter falling into the quarter chute swings the wire downward through an arc five times as large as that of the nickel chute and in a similar manner falls and exits from the lower end of the quarter chute after the appropriate movement of the trip wire.

Upon the downward swing of the trip wire, the ratchet wheel mounted on the shaft is rotated through a corresponding distance. After the coin releases the finger of the trip wire, the trip wire returns to the upward position with the ratchet wheel being retained in the particular rotational position by a retaining pawl which engages the teeth at the outer edge of the ratchet wheel. Clearly, as each additional coin is deposited in its appropriate chute, a corresponding mechanical ratcheting of the ratchet wheel will produce additional rotational movement and positioning of the ratchet wheel. With each tooth provided on the ratchet wheel representing each nickel value of the coin currency, the ratchet wheel is rotationally advanced according to the denomination of the coin currency deposited in the chutes. Specifically, the ratchet wheel is held in an advanced position against the biasing of a ratchet return spring by both a driving pawl and a retaining pawl. While there is included means for returning the ratchet wheel to its "zero" position after a pack of cigarettes has been removed from the machine, it is most significant to understand that rotational position of the ratchet wheel, at any time after the insertion of some coins during the selection process, corresponds to the total amount of coin currency deposited in the slot.

Secured to the ratchet wheel for basic rotation therewith is a disc assembly which includes three separate discs. Each disc is adapted to be selectively positioned relative to the ratchet wheel according to the amount of coin currency which is required for the different priced packs of cigarettes. The three discs in the disc assembly include notches having radial shoulders on the leading ends thereof. While the operation of such discs is disclosed in detail in U.S. Pat. No. 3,028,940, it is sufficient to know that with the proper amount of coin currency being deposited in the chutes, the discs, as selectively positioned for the amount desired, will have the notches thereof advanced to a position to allow movement of one end of a corresponding one of three latch release bars. The other end of each of the three latch release bars is basically coupled to a corresponding one of the three release latches of the totalizer unit which control the movement of the release means of the basic machine mentioned hereinabove. Each release latch, through the release means, provides the last secure lockout means for preventing the movement of a cigarette pack selection knob which would dispense the pack unless moved to the release position. Each of the latch release bars is mounted for relative alignment with an appropriate one of the discs so that that individual latch release bar will not be capable of producing corresponding movement of its respective release latch to the release position unless the notch on its particular disc is properly oriented by the deposit of the correct amount of coin currency. Full movement of the respective latch release bars is only initiated when the selection knob is being pulled.

As described, it would appear that movement of the cigarette pack selection knob is configured to dispense the particular pack of cigarettes if the release means is simply withdrawn to the release position by the release latch to allow the particular pack to be dispensed from the machine. However, in order to provide a preferred method of operation of the entire dispensing mechanism, there are other features which are included in order for the overall totalizer unit to operate in an effective and reliable manner. Accordingly, as a purchaser begins to pull the particular selection knob, other components within the totalizer unit produce the initial movement of each of the latch release bars. The latch release bars are basically biased away from the discs so that there is no mechanical, sliding contact therebetween until a particular selection knob is physically pulled by a purchaser with the intention of actually dispensing the selected pack of cigarettes. In other words, the initial movement of the selection knob produces an initial movement of the latch release bar against biasing to determine if the appropriate notch is properly aligned to allow continued movement of the latch release bar which would result in the movement of the release latch and the release means to the release position. If the selected knob is pulled prior to the proper amount of coin currency being deposited in the coin channels, the corresponding disc will not be properly oriented to align the notch to allow full movement of the latch release bar. If the proper amount of coin currency has not been received in the totalizer unit, continued movement of the selection knob which is needed to directly dispense the pack of cigarettes is prevented by the fact that the release latch of the totalizer unit and the release means of the basic machine has not been moved to the release position. If the proper amount of coin currency has passed through the coin chutes, the alignment of the notch on the disc allows full movement of the latch release bar to move the release latch, and thus the release means, to the release position and continued movement of the selection knob causes the selected pack of cigarettes to be dispensed.

When a purchaser releases the selection knob, additional mechanisms within the totalizer unit and within the vending machine itself, returns the ratchet wheel and discs to the "zero" position. When in the "zero" position, full movement of any of the selection knobs is prevented, because the release latches, and thus the release means, will not be returned to the release position until the proper amount of coin currency has been deposited through the chutes. Of course, the return of the selection knob to the non-selected position also allows each of the latch release bars to be biased to prevent any engagement with the respective discs until another selection is being made.

It should be recognized that U.S. Pat. Nos. 2,993,581 and 3,028,940 disclose specific mechanisms for initially producing the desired movement of the latch release bars upon the movement of the selection knob and particular linkage means for resetting the ratchet wheel and discs to the "zero" position after a selection has been made. The same functions are provided by different mechanisms in the preferred existing cigarette vending machine and will be specifically discussed in the Detailed Description of the Preferred Embodiments hereinbelow. In other words, although a detailed description of the particular components employed in the specific existing cigarette vending machine to be modified by the preferred apparatus and method is provided hereinbelow, the functions produced by those particular components are well known in the cigarette vending machine art and produced, for example, by other specific configurations in U.S. Pat. Nos. 2,993,581 and 3,028,940.

As thus described, the basic devices disclosed in U.S. Pat. Nos. 2,993,581 and 3,028,940 have been found to function properly and to insure the proper selection and dispensing of an appropriate pack of cigarettes. While these patents disclose mechanisms which were satisfactory, the preferred existing cigarette vending machine, which is to be specifically modified by the present invention, has experienced greater acceptance and use throughout the cigarette vending field. In either case, such mechanical vending machines would likely have continued to be extensively used in the cigarette vending field if it were not for the increasing cost of a pack of cigarettes.

For example, a preferred existing mechanical totalizer unit which has provided the same functions as those described hereinabove is described in detail hereinbelow. The existing mechanical totalizer unit to be modified by the present invention has been offered by National Vendors, Inc., under a number of different model numbers depending on the particular amount of money which may be selected for the cost of the various packs of cigarettes therein. For example, Series 560 ACMR, as manufactured, provided a price range from $0.05 through $0.60. The Series 100 ACMR and 5100 ACMR, had a price range from $0.05 through $1.00. The Series 130 ACMR included a price range of $0.05 through $1.30 while Series 160 ACMR had a price range from $0.05 through $1.60. Accordingly, while the basic mechanisms are the same, it can be seen that different ratchet wheel and disc configurations have been needed in these mechanical totalizer units because of the increasing cost of the packs of cigarettes to be dispensed thereby.

In fact, with still further increases in the cost of a basic pack of cigarettes, one major cigarette company has offered a means for physically replacing the disc assemblies provided by National Vendors, Inc. with a different disc assembly and a physical conversion of the quarter channel to produce a different amount of travel for the trip wire. As a result, the converted mechanical totalizer unit would function in a similar manner but has resulted in the totalizer unit being capable of receiving, in one case, up to $2.25 and, in another case, up to $2.60 in coins for the dispensing of packs of cigarettes at an increased cost.

In the meantime, National Vendors, Inc., also recognized the need for some other means to increase the amount of coin currency which can be selectively deposited in their existing cigarette vending machines. Consequently, National Vendors, Inc., introduced an electronic coin totalizer unit, such as the Series 600 Electronic ACMR unit, which could be mounted within the existing cigarette vending machines to replace the mechanical coin totalizer units discussed hereinabove. The new electronic coin totalizer unit was adapted to control the same type of mechanical dispensing mechanism including the release means discussed hereinabove.

The new electronic coin totalizer unit included different coin channel configurations and a different, electronic means for actually sensing the coin currency deposited therein. Nevertheless, the existing cigarette vending machines functioned in a similar manner and continued to rely upon the series of three release means which must still be moved to the release position to allow continued movement of the selection knob actually needed to dispense the selected pack of cigarettes. An alternative linkage within the electronic coin totalizer unit again allowed it to be returned to the "zero" position after a proper selection has been made and the selection knob is returned to the "non-selected" position. The Series 600 Electronic ACMR has a price range from $0.05 through $6.35. Accordingly, it would appear that owner-operators of the existing mechanical cigarette vending machines could provide a reasonable conversion thereof through the use of the electronic coin totalizer unit offered by National Vendors, Inc. Such a conversion would allow continued use of the reliable cigarette vending machines employing the mechanical dispensing mechanisms having the release means while being able to select an appropriate price range for the packs of cigarettes to be dispensed thereby.

It should be noted that the various models of the mechanical totalizer units, which were offered by National Vendors, Inc., and which were modified to accept more coin currency by the major cigarette company, were adapted and converted to allow a selection of higher prices for the packs of cigarettes but some of these higher prices are below the current prices of such cigarettes in the industry. Further, while there was some acceptance of the electronic coin totalizer unit offered by National Vendors, Inc., which would allow more coin currency to be deposited in the machine, the cost of completely replacing the mechanical totalizer unit with an electronic coin totalizer unit was relatively high. Consequently, some time ago, another company, Holiday Electronics of Phoenix, Ariz., offered a different conversion of the mechanical totalizer units of National Vendors, Inc. The conversion required removal of the mechanical coin recorder mechanism and replaced it with an electronic coin adding device. The conversion basically employed a similar trip wire configuration but included an electronic means for adding the coin currency and for selectively varying the price of the cigarettes. A similar mechanical operation of the remaining components of the mechanical totalizer unit is produced after the higher amount of coin currency has been deposited. The cost of a pack of cigarettes could be varied from $0.05 to $6.35. However, this conversion has had only limited success because of the questionable reliability of the electronic coin currency adding device.

If the various packs of cigarettes were to have remained at a relatively low cost, although still above that offered by some of the various mechanical totalizer units discussed above, one would assume that the entirely different electronic totalizer unit or the electronic coin adding device would provide an acceptable, satisfactory and convenient means for continued use of the basic existing vending machines having the reliable mechanical dispensing mechanisms. However, with the continued increase of the price of various packs of cigarettes, the amount of coin currency which is physically required for the dispensing of cigarettes has significantly increased. The actual physical amount of coin currency required has clearly discouraged use of any cigarette vending machine relying entirely on coin currency for the dispensing of packs of cigarettes thereby.

Because of the large amount of coin currency that is required for the purchase of cigarettes at the present time, a number of new cigarette vending machines have been introduced which include paper currency acceptance and verification units. If the price of a pack of cigarettes, for example, is $3.00, three one dollar bills can simply be deposited in the paper currency verification and totalizer portion of such new cigarette vending machines for the selection and dispensing of a pack of cigarettes therefrom. Most of these new cigarette vending machines also include coin currency depositing means so that either coin and/or paper currency can be deposited therein for the dispensing of packs of cigarettes. However, these new cigarette vending machines which are capable of receiving coin and/or paper currency are relatively expensive. Clearly, in order to provide such machines, owner-operators require a significant initial investment for the purchase of such machines and must accept the fact that the withdrawal of existing mechanical vending machines from service represents a total loss of such assets.

Another electronic totalizer unit was recently offered by WGB Manufacturing of Pittsburgh, Pa., under the Model No. ECKO 635 for use in the 222 and 800 series machines offered by National Vendors, Inc. However, the required physical modification of the mechanical coin totalizer units of National Vendors, Inc. was quite extensive for the owner-operators of cigarette vending machines in order to install the ECKO 635 conversion elements within the basic frame and housing of the mechanical coin totalizer unit. Basically, the major internal mechanisms had to be completely removed which often required the drilling out of original welds and the like. The conversion of the interior of the mechanical coin totalizer unit was so extensive that the only components which remained therein included the three release latches and some of the channeling means at the lower end thereof for the collection of coins and the return of coins to a return chute.

The ECKO 635 conversion allowed a total deposit of up to $6.35 and included the capability of adding a paper currency verification and sensing device if desired. With the interior components removed but the basic frame and housing of the mechanical coin totalizer unit being retained, the ECKO 635 conversion required an entirely new configuration of coin slots, a new electronic coin adding means in the form of a printed circuit board mounted within the housing of the mechanical totalizer unit, and an electrical actuation means for operating one of the release latches. The conversion to accept paper currency was made by an electrical coupling of a separate paper currency verification and sensing device to the basic printed circuit board of the ECKO 635 totalizer unit.

There has been little acceptance of the ECKO 635 electronic totalizer unit because of the extensive and time consuming conversion and numerous problems associated with its operation. For example, there was included no means for indicating the total amount of coins and/or paper currency which was deposited therein. Additionally, it was found that electronic noise was experienced within the printed circuit board located within the housing of the totalizer unit which occasionally resulted in giving a potential purchaser "free" credit for currency not actually deposited therein to allow improper dispensing of a pack of cigarettes from the vending machine. Some problems associated with the printed circuit board being installed within the housing of the totalizer unit might have occurred because of the excessive mechanical vibrations which occurred through repeated opening and closing of the door of the vending machine when adding packs of cigarettes to or removing coin or bill currency from the machine. The mechanical vibrations of such mechanically operated vending machines is quite extensive and tends to provide an unfavorable environment for the reliable operation of the printed circuit board. Additional problems resulted from the fact that the overall system allowed the return of coin currency but included no means for the return of bill currency if the purchaser chose not to make a selection after coin and paper currency had been deposited for the purchase of a pack of cigarettes. Accordingly, the ECKO 635 electronic totalizer unit by WBG Manufacturing is no longer being offered and is no longer considered an acceptable alternative for the conversion of existing vending machines.

As a result, owner-operators of cigarette vending machines have remained interested in a reliable means to accept paper currency but in continuing to use existing cigarette vending machines which employ the reliable mechanical dispensing mechanisms. There has remained a need for being able to reliably convert various vending machines which accepted coin currency to also be capable of accepting paper currency.

One such conversion has been offered by the Revenco Corporation of North Huntingdon, Pa., and sold under the trademark THE BILL COLLECTOR. THE BILL COLLECTOR basically includes a system which utilizes a separate box or housing attached to the outside of the existing cigarette vending machine. The separate box includes any one of numerous paper currency verification and recording devices which are well known in the vending field. The separate box also includes electronic control means, in the form of a specifically designed printed circuit board, to produce a particular electronic output signal indicative of the amount of paper currency deposited therein. However, such electronic circuitry in the printed circuit board would not be universally applicable for all cigarette vending machines. The electronic counting means therein produces an electronic output signal, however, which cannot be utilized in any of the mechanical coin totalizer units discussed hereinabove. The basic purpose of the paper currency receiving box is to include a means for "fooling" the existing electronic coin currency totalizer units in some of the existing cigarette vending machines. For example, the electronic coin currency totalizing function of the device sold by Holiday Electronics, Inc., includes electronic signaling means therein to indicate when an appropriate total amount of coin currency has been deposited in the mechanical totalizer unit. Accordingly, the electronic control means and printed circuit board of one model of the THE BILL COLLECTOR box is particularly adapted to provide an electronic signal to the electronic coin totalizer mechanism to "fool" the mechanism into believing that a proper amount of coin currency has been deposited even though the electronic signal is actually received from the attached box when an appropriate amount of paper currency has been deposited therein.

While the physical conversion to accept THE BILL COLLECTOR box is within the capability of most owner-operators of existing vending machines, it is relatively complicated and has lead to some difficulty. For example, some relatively difficult wire soldering of the small printed circuit board of the electronic coin adding device is required and, as mentioned above, the basic mechanism itself is not always considered that reliable. Therefore, while the use of the separate, attached box for the receipt of paper currency has been generally accepted, wide acceptance has not occurred because of the unreliable operation of the electronic coin adding device by Holiday Electronics, Inc., and the difficulty of producing a reliable solder on the small printed circuit board thereof.

The same model of THE BILL COLLECTOR box, which includes the same electronic control means and printed circuit board, could be used to produce a similar "fooling" of the electronic coin adding and counting function of the Series 600 Electronic ACMR models offered by National Vendors, Inc. However, the required soldering to the small printed circuit board is again very difficult and not always reliable. Once installed, the device functions in a similar manner as additional wiring to the printed circuit of the electronic totalizer unit provides additional electronic signals to produce the same results by the deposit of paper currency in the attached box as would otherwise be produced by the deposit of coin currency in the existing cigarette vending machine.

Accordingly, although there has been some acceptance of the general concept of providing a separate, attached box for the receipt of paper currency to convert various existing cigarette vending machines, the general acceptance has been limited because of the need for a particular electronic circuit and printed circuit board for the electronic coin adding devices or electronic coin currency totalizer units employed in a limited number of cigarette vending machines. The separate, attached box of THE BILL COLLECTOR system for the receipt of paper currency could not be employed with any such machine having a mechanical coin currency totalizer unit.

U.S. Pat. No. 4,884,671, entitled Paper Currency Accepter And Method Of Handling Paper Currency For Vending Machines And The Like, discloses a paper currency accepter which can be installed within the front panel of an existing vending machine. While the paper currency accepter is suggested to be used in conjunction with existing coin currency accepting means, the disclosure does not indicate how the existing coin mechanism can be altered or modified to operate in conjunction with the new paper currency accepter. Accordingly, while suggesting the use of such a paper currency accepter which may physically be capable of installation on the front panel of a vending machine, little information is provided to disclose or suggest to those skilled in the art how such a paper currency accepter can be actually employed in an existing vending machine for use in conjunction with the existing coin currency accepter thereof.

While it is clear that there has been an extensive and continuing evolution of cigarette vending machines, it should be recognized that the existing mechanical dispensing mechanisms and the existing mechanical totalizer units of the cigarette vending machines produced many years ago by National Vending, Inc., would probably still be extensively used if the basic cost of a pack of cigarettes had not increased. These older mechanical cigarette vending machines were considered to be extremely reliable and were widely accepted by many owner-operators in the cigarette vending field. Additionally, it should be noted that the owner-operators of cigarette vending machines have been quite familiar with and accustomed to adapting, repairing and maintaining such vending machines. In fact, with a conversion, either through the use of the electronic coin adding device by Holiday Electronics or the alteration to include the electronic totalizer unit in the form of Series 600 Electronic ACMR by National Vendors, Inc., many, if not all, of these owner-operators would typically remove the mechanical totalizer units or components thereof and simply "store them away" in inventory for possible use at a future date. Most owner-operators of various vending machines are quite accustomed to the conversion, alteration and repair of various types of vending machines and recognize that components removed from one vending machine, because of a conversion, could later be employed in the same or similar machines which might be converted at some future date.

Consequently, because of the wide acceptance and satisfaction of the types of existing mechanical cigarette vending machines discussed hereinabove, any means which could be introduced to allow a convenient conversion thereof for the receipt of coin currency and/or paper currency would be highly desirable. With most owner-operators of vending machines being capable of and interested in simple, reliable conversion of such vending machines, there would clearly be a desire to convert any existing machine rather than to purchase an entirely different vending machine requiring a significant investment.

It should be noted that the existing cigarette vending machines which generally employ the reliable mechanical dispensing mechanisms, which have been and are still being produced by National Vendors, Inc., are extensively used throughout the cigarette vending field. Some such machines have been in existence for thirty years or more and are quite satisfactory for the dispensing of packs of cigarettes therefrom if they can be properly regulated and controlled by the proper depositing of currency therein. It should also be noted that, although the specific mechanical totalizer units produced by National Vendors, Inc., Series 100, 130, 160, 560 and 5100 ACMR, are not being extensively used, those which have been mechanically converted to accept more coin currency by the conversion of the quarter chute are still in extensive use.

Accordingly, many, if not most, of the basic mechanical totalizer units originally sold by National Vendors, Inc., are still available from machines which can accept up to $2.25 or $2.60 or from storage by most owner-operators of vending machines. It should be understood that the number of such cigarette vending machines and mechanical totalizer units probably exceeds one million. In other words, although perhaps a million of such mechanical totalizer units are in existence, it appears doubtful that they would continue to be used in the future. Because of the increased cost of a pack of cigarettes, they would soon be considered obsolete for use in the existing vending machines which employ the reliable mechanical dispensing mechanisms of the type described hereinabove because the large amount of coin currency required is proving to be increasingly inconvenient and unacceptable. Clearly, any coin and/or paper currency totalizing system which could be employed while utilizing the mechanical totalizer unit or major portions thereof in the existing cigarette vending machines which employ the existing mechanical control mechanisms would be highly desirable.

U.S. Pat. Nos. 2,292,628; 2,935,170; 2,993,581; 3,028,940; and 4,884,671 are incorporated by reference as if included in their entirety herein.

SUMMARY OF THE INVENTION

It is therefore an object of the present invention to provide an improved paper and coin currency totalizer for being installed on an existing vending machine.

It is another object of the invention to provide a method of converting the existing vending machine to enable paper currency and coin currency to be used to allow an item in the existing vending machine to be dispensed therefrom.

It is a further object of the present invention to utilize existing mechanical totalizer units and, more specifically, some of the portions thereof for a convenient and reliable conversion of the existing vending machines which include reliable mechanical dispensing mechanisms.

It is still another object to provide a means for converting the existing vending machines which is simple, reliable and significantly less expensive than would be an entirely new vending machine having the capability of receiving paper currency and/or coin currency.

These and other objects of the invention are provided in a preferred embodiment thereof including an improved paper and coin currency totalizer for being installed on an existing vending machine. The existing vending machine is of the type having an existing totalizer unit which includes an existing coin receiving channel, an existing movable mechanical release device for being moved to a release position to allow an item in the vending machine to be dispensed, and an existing movable mechanical reset mechanism which is for being moved to a reset position after the item is dispensed. The improved paper and coin currency totalizer includes an electronic coin currency sensor mounted in the existing totalizer unit in alignment with the coin receiving channel. The electronic coin currency sensor is for producing a coin signal when a coin currency passes through the coin receiving channel and by the electronic coin currency sensor. An electronic paper currency sensor is for producing a paper signal when a paper currency is deposited in and verified by the electronic paper currency sensor. A currency totalizer control circuit is for receiving each paper signal from the electronic paper currency sensor and each coin signal from the electronic coin currency sensor. The currency totalizer control circuit includes a currency amount function for determining by a total of the paper signals and the coin signals when a predetermined amount of currency has been deposited in the electronic paper currency sensor and through the coin receiving channel. An actuation element mounted in the existing totalizer unit is for moving the mechanical release device in the existing totalizer unit to the release position. The currency totalizer control circuit includes an actuation signal function for sending an actuation signal to the actuation element from the currency amount function when the predetermined amount of currency has been deposited in the electronic paper currency sensor and through the coin receiving channel. A reset sensor is mounted in the existing totalizer unit in alignment with the movable mechanical reset mechanism when moved to the reset position for producing a reset signal. The currency totalizer control circuit is for receiving the reset signal and for discontinuing the actuation signal to the actuation element when the reset signal is received from the reset sensor.

In the improved paper and coin currency totalizer, the currency totalizer control circuit can include a variable selection function for selectively varying the predetermined amount of currency needed to produce the actuation signal by the currency amount function.

The improved paper and coin currency totalizer preferably includes the electronic coin currency sensor, the actuation element, and the reset sensor being mounted on a support plate which is installed within the existing totalizer unit.

The improved paper and coin currency totalizer can further include a housing secured to an outside wall of the existing vending machine with the electronic paper currency sensor and the currency totalizer control circuit being mounted within the housing.

In the improved paper and coin currency totalizer, the currency totalizer control circuit includes a currency display element indicating an amount of currency corresponding to the total of the paper signals and the coin signals and the currency display element is mounted at the front of the housing.

The improved paper and coin currency totalizer further includes first electrical wiring, second electrical wiring and third electrical wiring between the existing totalizer unit and the housing. The first electrical wiring operably connects the electronic coin currency sensor and the currency totalizer control circuit for providing the coin signal. The second electrical wiring operably connects the currency totalizer control circuit and the actuation element for providing the actuation signal. The third electrical wiring operably connects the currency totalizer control circuit and the reset sensor for providing the reset signal.

In the improved paper and coin currency totalizer, the coin receiving channel is configured for passing a quarter therethrough and the electronic coin currency sensor provides a coin signal for each quarter passing thereby. The electronic paper currency sensor is configured to receive and verify at least a one dollar bill passing therethrough. The electronic paper currency sensor provides the paper signal for at least each one dollar bill passing therethrough. The predetermined amount of currency of the currency amount function is established by an electronic summation of the paper signals and/or the coin signals respectively from the electronic paper currency sensor and the electronic coin currency sensor. The preferred variable selection function can be for selectively varying, at one quarter increments, said predetermined amount of currency ranging from $0.25 to $7.75.

Another preferred embodiment of the invention includes an improved paper and coin currency totalizer for being installed on an existing vending machine. The existing vending machine is of the type having an existing totalizer unit which includes an existing coin receiving channel, an existing movable mechanical release device for being moved to a release position to allow an item in the vending machine to be dispensed, and an existing movable mechanical reset mechanism which is for being moved to a reset position after the item is dispensed. The improved paper and coin currency totalizer includes a housing mounted on an outside wall of the existing vending machine. An electronic paper currency sensor and a currency totalizer control circuit are mounted within the housing. An electronic coin currency sensor is mounted in the existing totalizer unit in alignment with the coin receiving channel. The electronic coin currency sensor is for producing a coin signal when a coin currency passes through the coin receiving channel and by the electronic coin currency sensor. The electronic paper currency sensor is for producing a paper signal when a paper currency is deposited in and verified by the electronic paper currency sensor. The currency totalizer control circuit is for receiving each paper signal from the electronic paper currency sensor and each coin signal from the electronic coin currency sensor. The currency totalizer control circuit includes a currency amount function for determining by a total of the paper signals and the coin signals when a predetermined amount of currency has been deposited in the electronic paper currency sensor and through the coin receiving channel. An actuation element mounted in the existing totalizer unit is for moving the mechanical release device in the existing totalizer unit to the release position. The currency totalizer control circuit includes an actuation signal function for sending an actuation signal to the actuation element from the currency amount function when the predetermined amount of currency has been deposited in the electronic paper currency sensor and through the coin receiving channel. A reset sensor is mounted in the existing totalizer unit in alignment with the movable mechanical reset mechanism when moved to the reset position for producing a reset signal. The currency totalizer control circuit is for receiving the reset signal and for discontinuing the actuation signal to the actuation element when the reset signal is received from the reset sensor.

The preferred embodiment of the invention also includes a method of converting an existing vending machine to enable paper currency and coin currency to be used to allow an item in the existing vending machine to be dispensed therefrom. The existing vending machine is of the type which is coin operated and has an existing totalizer unit which includes a plurality of coin receiving channels and a coin sensing device for sensing when coin currency is deposited in the plurality of coin receiving channels. A totalizer is for totaling the coin currency passing through the plurality of coin receiving channels as sensed by the coin sensing device and for determining when a predetermined total of the coin currency has been deposited therein. A movable mechanical release device is for being moved to a release position to allow the item to be dispensed. A first actuation element is operably controlled by the totalizer when the first predetermined total of the coin currency has been deposited in the plurality of coin receiving channels for moving the movable mechanical release device to the release position. A movable mechanical reset mechanism is for movement to a reset position to reset the totalizer and to move the movable mechanical release device away from the release position after the item is dispensed. The preferred method includes the steps of:

removing the coin sensing device;

removing the totalizer;

removing the first actuation element;

securing a housing to the existing vending machine;

providing a currency totalizing control circuit within the housing the currency totalizing control circuit including a currency adding function;

installing an electronic coin currency sensor in the existing totalizer unit in alignment with a first coin receiving channel of the plurality for sensing the coin currency passing thereby;

installing a second actuation element in the existing totalizer unit for being actuated to move the movable mechanical release device to the release position;

installing a reset sensor in the existing totalizer unit in alignment with the movable mechanical reset mechanism when moved to the reset position;

providing an electronic paper currency sensor within the housing for sensing the paper currency passing therethrough;

operably connecting the currency totalizing control circuit to the electronic coin currency sensor and the electronic paper currency sensor for determining through the currency adding function when a predetermined total currency is sensed by the electronic coin currency sensor and/or the electronic paper currency sensor;

operably connecting the currency totalizing control circuit to the second actuation element for actuation thereof when the predetermined total currency is determined by the currency adding function; and operably connecting the currency totalizing control circuit to the reset sensor, the currency totalizing control circuit for being reset and for discontinuing actuation of the second actuation element when the movable mechanical reset mechanism is moved to the reset position as sensed by the reset sensor.

The method of converting the existing machine further includes the step of providing a currency display element on the housing for indicating a current total currency sensed by the electronic coin sensor and/or the electronic paper currency sensor prior to the item being dispensed from the existing vending machine.

The method of converting the existing vending machine, wherein the existing totalizer unit includes a retaining mechanism for temporarily retaining the coin currency below the plurality of coin receiving channels, further includes the step of removing the retaining mechanism from the existing totalizer unit and the installing of the electronic coin currency sensor is in a region of the existing vending machine below the first coin receiving channel.

The method of converting the existing vending machine wherein the existing totalizer unit includes internal wall elements cooperating with the retaining elements, further includes the steps of removing the internal wall elements, providing a support plate having the electronic coin currency sensor, second actuation element and the reset sensor mounted thereon, and mounting the support plate within the existing totalizer unit.

DETAILED DESCRIPTION OF THE PREFERRED EMBODIMENT

Figure 1:
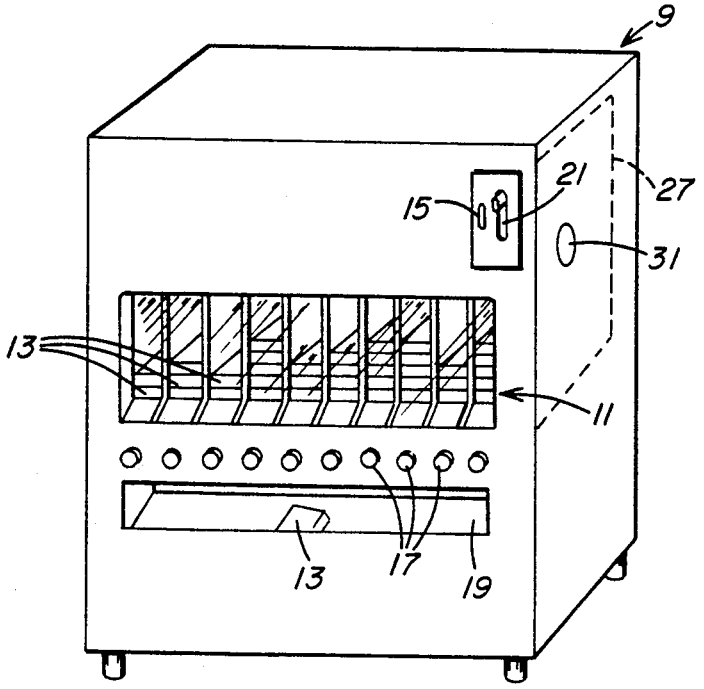
FIG. 1 PRIOR ART
FIG. 1 is a perspective view of a typical prior art existing vending machine including various features which are to be incorporated in the preferred improved paper and coin currency totalizer of the present invention.

As seen in FIG. 1, an existing cigarette vending machine 9 basically includes a mechanical coin totalizer unit and mechanical cigarette pack dispensing mechanism for the dispensing of cigarettes therefrom. The existing cigarette vending machine 9, which will be modified by the present invention, could be any one of a number of models such as those sold by National Vendors, Inc.

The basic cigarette vending machine 9, prior to the modification would typically include a viewing window 11, through which a potential purchaser can determine which packs 13 of cigarettes are available. The purchaser would deposit a proper amount of coin currency in the form of nickels, dimes and/or quarters in the coin slot 15. Such machines 9 can be configured to offer packs of cigarettes which are to be purchased for different prices.

After the proper amount of coin currency has been deposited in the slot 15, the purchaser could select the pack 13 of cigarettes corresponding to the amount of money deposited by simply pulling the appropriate selection knob 17. The selected pack 13 of cigarettes would be dispensed to a tray 19 physically below the selection knob area. As will be seen, if the purchaser deposited the maximum amount of coin currency required for the most expensive pack 13 of cigarettes, any one of the selection knobs 17 could be pulled for the dispensing of any pack 13 of cigarettes including those costing less than the more expensive packs 13.

An additional feature of interest in the existing cigarette vending machine 9 includes the capability of the purchaser to change his mind regarding the purchase of a pack 13 of cigarettes. After coin currency has been deposited in the slot 15, if no selection knob 17 has been pulled, the purchaser can pull down a coin rejection lever 21 to cause all of the coins to be ejected to the tray 19 for recollection by the purchaser.

As will be seen, the present invention requires significant modification of the mechanical totalizer unit within the cigarette vending machine 9 and, after the preferred embodiment of the present invention is installed, the machine 9 will generally operate in a different manner. For example, with the preferred embodiment of the present invention, the owner-operator of the machine 10 would only offer packs 13 of cigarettes for one particular price. Additionally, there would be an indication on the machine 9 that only quarters should be deposited in the coin currency slot 15. If the wrong coin currency or a slug is deposited therein, the coin accepter and slug ejector would be employed to insure that only quarters are accepted. The coin rejection lever 21 would be used to remove jams or other slugs in the same manner as before. However, the instructions on the machine 9 would make it clear to a potential purchaser that the coin rejection lever 21 could not be used to return all currency deposited therein simply because the purchaser determined not to make a selection. There is included no means in the preferred embodiment of the present invention for the return of any proper coin and/or paper currency which has been deposited and accepted for the eventual selection of a pack 13 of cigarettes.

Figure 2:
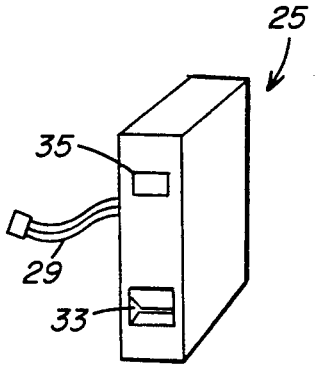
FIG. 2 is a perspective view of a box including components of the preferred paper and coin currency totalizer of the present invention for being installed on the existing cigarette vending machine of FIG. 1.

The preferred embodiment of the present invention primarily includes, in addition to the modifications within the existing machine 9, an added box 25 as seen in FIG. 2. The box 25 is preferably installed on the side of the machine 9 in the region indicated by the dotted line 27 in FIG. 1. The box 25 includes a wire harness 29 extending therefrom for insertion into the machine 9 through a hole 31 in the side wall of the machine 9 provided for this purpose.

The preferred box 25, as will be seen, includes a paper currency receiving opening 33 on the front face thereof. An electronic currency display 35 indicates the amount of coin and/or paper currency which has been deposited in the paper currency slot 33 and/or the coin slot 15 toward the purchase of a pack 13 of cigarettes. More significantly, the box 25 will be seen to include a currency totalizer control means 37 in the form of a specifically designed printed circuit board for performing the operation and control functions which will be discussed hereinbelow. The preferred printed circuit board includes the electronic currency display 35, in the form of a LED or the like, mounted thereon and is installed in the box 25 so that the display 35 can be clearly seen on the front of the box 25 by a purchaser.

Figure 3:
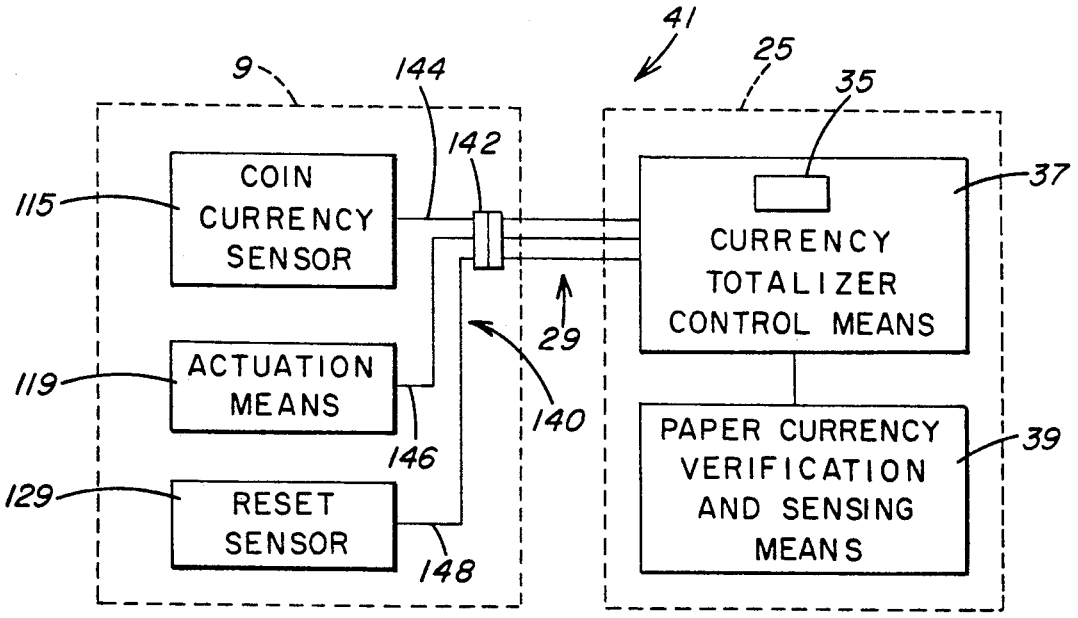
FIG. 3 is a diagram of the improved paper and coin currency totalizer of the present invention indicating the various components thereof which are preferably included in the box of FIG. 2 and the existing cigarette vending machine of FIG. 1.

As shown schematically in FIG. 3, the preferred embodiment of the invention includes the improved paper and coin currency totalizer 41 including components which are physically provided in the box 25 and in the vending machine 9. The box 25 primarily includes the currency totalizer control means 37, which is preferably in the form of the specifically designed printed circuit board having the display 35 thereon. Such printed circuit boards are well known in the vending machine art and are within the design capability of those skilled in the vending machine art when it is determined which functions are to be performed and which specific components, available through other means, are to be utilized. The preferred printed circuit board would include selection switches (not shown) to provide a variable selection means for selectively varying the predetermined amount of currency needed to allow the selection of a pack of cigarettes. In the preferred currency totalizer control means 37, the predetermined amount of currency can be selectively varied by the selection switches, at quarter increments, ranging from $0.25 to $7.75.

Also housed within the box 25 is one of numerous types of paper currency verification and sensing means 39 which are readily available and well-known in the vending machine field. The preferred paper currency verification and sensing means 39 may be, for example, of the type sold by Mars Electronics of West Chester, Pa., under the Model No. VFM1.

Figure 6:
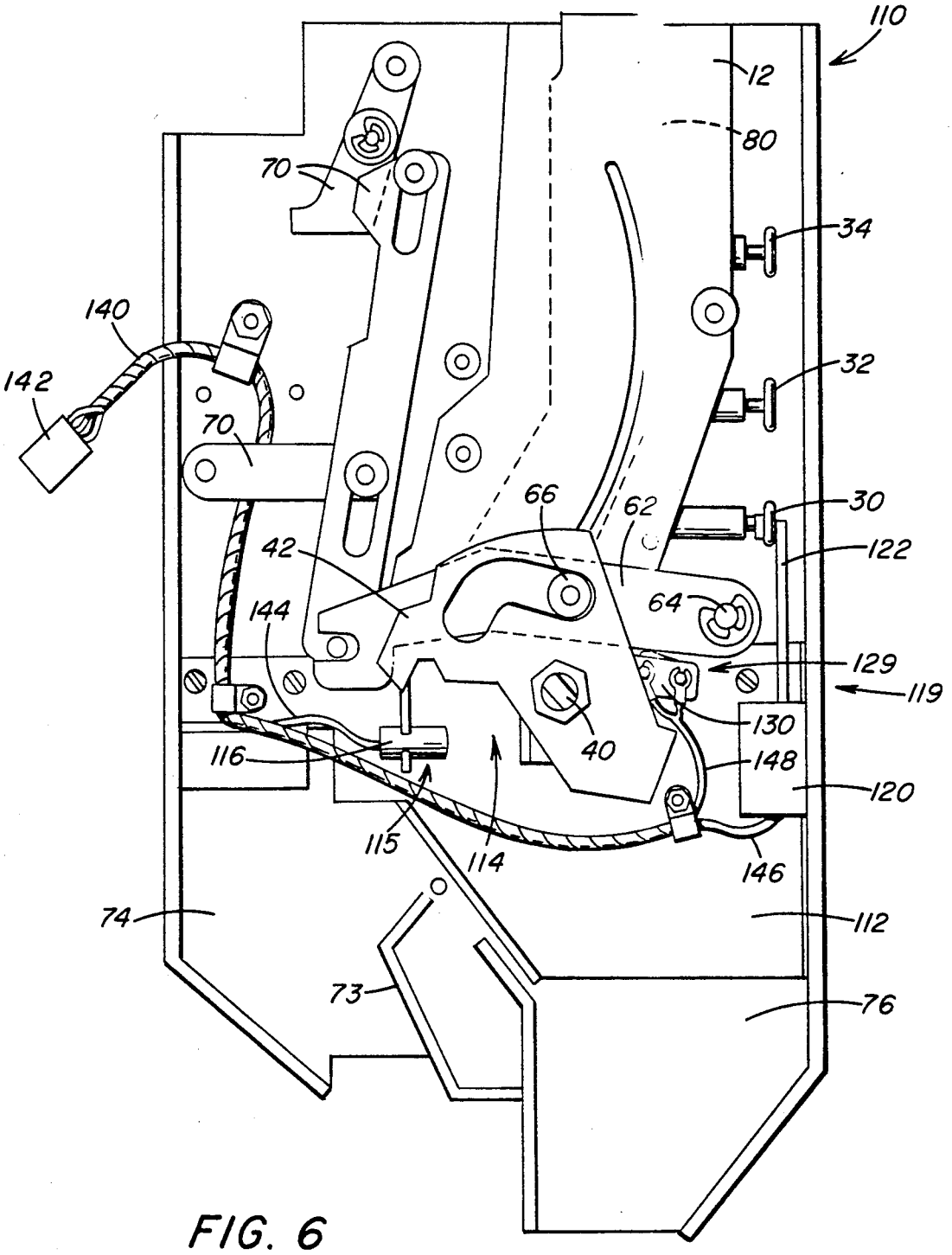
FIG. 6 is the modified totalizer unit of FIG. 5 as converted to include the essential components of the preferred paper and coin currency totalizer which are to be located within the cigarette vending machine of FIG. 1.

The preferred paper and coin currency totalizer system 41 also includes components which are installed within the machine 9. The components installed within the machine 9 will be seen to provide the desired functions and operations while utilizing some of the mechanical components in the existing machine 9 and the mechanical totalizer unit and mechanical dispensing mechanism thereof. The components of the paper and coin currency totalizer system 41 within the machine 9 include a coin currency sensor 115, actuation means 119 and a reset sensor 129, which are best seen in FIG. 6 and discussed in detail hereinbelow. The coin currency sensor 115 would preferably be an optic device of the type sold under the Model No. OPB800W55 by Optek Technology, Inc. of Carrollton, Tex. The actuation means 119 will be capable of allowing the purchaser to pull an appropriate selection knob 17 for the dispensing of a pack 13 of cigarettes after a proper amount of currency has been deposited. In other words, the actuation means 119 does not actually perform any direct function for the dispensing of a pack 13 of cigarettes but simply allows the purchaser to pull a desired selection knob 17 for the dispensing of a pack 13 of cigarettes with the existing mechanical dispensing mechanism in the machine 9. The reset sensor 129 includes means, also within the machine 9, for sensing the mechanical dispensing of the pack 13 in order to indicate when the selection has been made. The reset sensor 129 provides a signal to the currency totalizer control means 37 for resetting the entire paper and coin currency totalizer system 41 to indicate that a selection has been made and additional currency must be deposited in either the coin slot 15 or the paper slot 33 prior to the disposition of another pack 13 of cigarettes.

Figure 4:
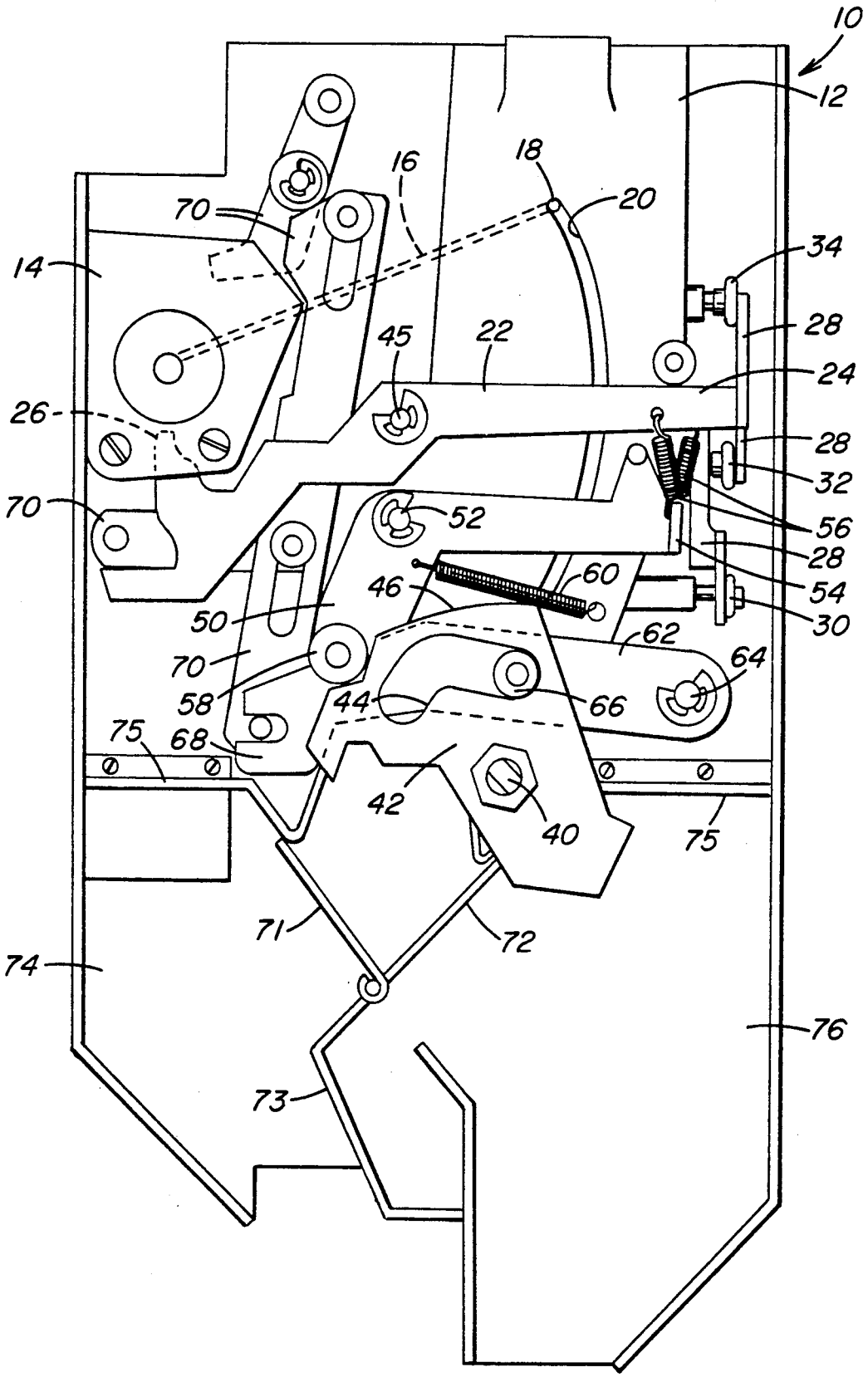
FIG. 4 PRIOR ART
FIG. 4 is an elevational view of a prior art mechanical totalizer unit typically employed in existing cigarette vending machines of the type shown in FIG. 1.

As seen in FIG. 4, an existing mechanical totalizer unit 10 within such machines 9 has been extensively sold by National Vendors, Inc., and has been successfully utilized throughout the cigarette vending machine field in the past. The mechanical totalizer unit 10 includes numerous components and features as disclosed in detail in U.S. Pat. Nos. 2,993,581 and 3,028,940. While most of the mechanical components which are provided in the preferred mechanical dispensing mechanisms for the cigarette vending machines 9 are not shown in FIG. 1, as will be seen, the function and operation of the components which directly relate to the operation of the mechanical totalizer unit 10 will be discussed hereinbelow.

As shown in FIG. 4, the cover plate of the mechanical totalizer unit 10 has been removed to reveal the interior of the unit 10 as it would be seen from the right side of the cigarette vending machine 9. In other words, after coin currency has been deposited in the coin slot 15, it would pass through a coin selector and slug rejecter device (not shown) which would be physically above the mechanical totalizer unit 10. Each accepted coin would be directed to one of three coin chutes (not shown) in a coin chute assembly 12.

In order to determine if a proper amount of coin currency has been deposited in the coin chute assembly 12, a mechanical coin recorder mechanism 14 is mounted in the totalizer unit 10 and includes a trip wire 16. The extended finger 18 of the trip wire 16 extends through an arcuate slot 20 which intersects each of the chutes of the coin chute assembly 12. As discussed above, when a nickel passes through the nickel chute, the extended finger 18 is deflected along the arcuate slot 20 to produce a predetermined movement of the trip wire 16. A dime would move the trip wire 16 twice as far as that produced by a nickel and a quarter would produce movement of the trip wire 16 through an arcuate distance which is five times that produced by a nickel. Movement of the trip wire 16 causes a ratchet wheel (not shown) in the mechanical coin recorder mechanism 14 to be advanced in order to mechanically add the amount of coin currency passing through the chutes. Depending on the actual amount of currency selected to be deposited for each of the three different prices of cigarettes which are being offered in the cigarette vending machine 9, each of three separate discs (not shown) within the coin recorder mechanism 14 will be advanced for possible alignment of the notches thereof with respective latch release bars 22.

Although it may appear from FIG. 4 that there is only one latch release bar 22, the three latch release bars 22 are generally aligned to cause two of the bars 22 to be behind the one actually shown. Each latch release bar 22 is mounted on a common pivot 45 and includes a first end 24 and a second end 26. The first end 24 of each latch release bar 22 includes a connecting element 28. The connecting element 28 for each of the latch release bars 22 extends respectively to one of three release latches 30, 32, 34.

Each of the three release latches 30, 32, 34 of the totalizer unit 10 extends through the rear wall thereof to produce movement of the release means (not shown) of the vending machine 9. Movement of the release means (not shown) to the release position by downward movement of its respective release latch 30, 32, 34 allows any of the selection knobs 17 for a particular price of cigarettes to be pulled for the dispensing of the pack 13 by the mechanical dispensing mechanism. Downward movement of the release latch 30 will produce movement of one of the release to the release position. Similarly, downward movement of release latch 32 allows any of the selection knobs 17 of a different price of cigarettes to be pulled when its corresponding release means is moved to the release position. The third release latch 34, upon being moved downwardly, produces similar movement of its corresponding release means to the release position.

As thus described, although a proper amount of coin currency may have been deposited to produce movement of the ratchet wheel within the coin recorder mechanism 14 for advancement of the respective discs thereof, no movement of the latch release bars 22 will occur until one of selection knobs 17 has been pulled. In other words, although the second end 26 of any one of the latch release bars 22 may be properly aligned with the corresponding notch in its respective disc, the actual upward movement of the second end 26 toward the disc or downward movement of the first end 24 to produce movement of its respective release latch 30, 32, 34 and release means will not occur until there is an attempt by the purchaser to select the desired pack 13 of cigarettes through the pulling movement of the selection knob 17. As discussed above, in order to insure continued reliable operation of the coin recorder mechanism 14, any contact between the respective discs therein and the second ends 26 of the latch release bars 22 is not desired unless a selection is actually being made.

When a proper amount of coin currency has been deposited in the cigarette vending machine 9 to produce the alignment of the notch in the disc in the coin recorder mechanism 14 for selecting a particular pack 13 of cigarettes, a purchaser would be in a position to select the desired pack 13 of cigarettes. Although all of the internal components of the mechanical dispensing mechanism within the cigarette vending machine 9 are not shown, initial movement of any of the selection knobs 17 would cause rotation of an actuation shaft 40 of the mechanical dispensing mechanism which extends through the back wall of the mechanical totalizer unit 10. An actuation cam 42 mounted on the end of the actuation shaft 40 basically provides two functions. As will be seen, one function produces movement of the latch release bars 22, and thus possible movement of the release latches 30, 32, 34 themselves, while the other function is to reset the mechanical coin recorder mechanism 14.

As shown in FIG. 4, the actuation shaft 40 and actuation cam 42 are in a inactive position without any purchaser having pulled one of the selection knobs 17. Upon pulling a selection knob 17, the actuation shaft 40 and actuation cam 42 are rotated clockwise to produce rotational movement of a cam slot 44 and a cam surface 46 of the actuation cam 42. The cam surface 46 is shaped to produce rotational movement of a release arm 50 mounted on a pivot 52. To produce the rotational movement of the release arm 50, one end thereof includes a release roller 58 which is in contact with the cam surface 46. The release arm 50 has an opposite, extended end 54 which includes three springs 56 which are respectively connected to the first ends 24 of the latch release bars 22. Consequently, if there were downward movement of the extended end 54, the springs 56 would cause the latch release bars 22 to be pulled downward by the respective springs 56 to rotate the latch release bars 22 about the common pivot 45. The release arm 50 is biased by a spring 60 in the counter-clockwise direction to maintain the release roller 58 in contact with the cam surface 46 of the actuation cam 42. The spring 60 tends to prevent any movement of the extended end 54 and springs 56 to produce downward movement of the first end 24 of the release latch bars 22 until positive movement is produced by the cam surface 46. As the actuation shaft 40 and actuation cam 42 rotate in a clockwise direction, the movement of the cam surface 46 beneath the release roller 58 produces clockwise rotation of the release arm 50 about the pivot 52. The increased force produced by the expansion of the springs 56 provides the desired rotational force on each of the release latch bars 22.

Once initial movement of the selection knob 17 has resulted in a clockwise force being applied to the first ends 24 of the latch release bars 22, the second ends 26 will, obviously, try to rotate in an upward direction toward the coin recorder mechanism 14. However, if the proper amount of coin currency has not been deposited through the coin chute assembly 12, the respective discs in the coin recorder mechanism 14 will not have been sufficiently advanced for the notch thereof to be aligned with the second end 26. If the discs are not properly advanced, continued upward movement of the second end 26 of the selected latch release bar 22 will be prevented. As a result, the first end 24 of the latch release bar 22 could not move downward despite the biasing force applied to the first end 24 by the extended end 54 and spring 56 of the release arm 50. Consequently, if the second end 26 is not capable of movement into its corresponding notch, the respective release latch 30, 32 or 34 will not move downward to cause its respective release means to be moved to the release position.

On the other hand, if a proper amount of coin currency has been deposited through the coin chute assembly 12 for a pack 13 of cigarettes requiring the least amount of coin currency, the appropriate latch release bar 22 will be properly aligned with the notch in the disc in the coin recorder mechanism 14. As a result, the latch release bar 22 may be rotated clockwise as the second end 26 extends into the notch. Upon movement of the selected latch release bar 22, the downward movement of the first end 24 and the connecting element 28 will cause its respective release latch 30, 32 or 34 to be moved downward to move the corresponding release means to the release position. Assuming the purchaser has selected a pack of cigarettes for that particular value, the continued movement of the selection knob 17 to physically dispense the selected pack 13 is possible when the release latch 30, 32, or 34 and thus the corresponding release means of the machine 9, is in the release position.

If the purchaser were to deposit more coin currency than required for the selected pack 13 of cigarettes at the minimum cost, each of the notches in the disc might be sufficiently advanced so that all of the three latch release bars 22 could be rotated. Consequently, the purchaser would be capable, after having deposited a sufficient amount of coin currency for the most expensive pack 13 of cigarettes in the cigarette vending machine 9, of pulling any of the selection knobs 17 to dispense any pack 13 of cigarettes therein because all three of the latch release bars 22 would be rotated in a clockwise direction to move all three release latches 30, 32, 34 to the release position. As a result, if the maximum amount of coin currency has been deposited in the cigarette vending machine 9, and thus through the mechanical totalizer unit 10, either the lower, middle or higher priced cigarettes could be selected for dispensing from the cigarette vending machine 9. If a purchaser deposited a sufficient amount of coin currency for the most expensive pack 13 of cigarettes therein but inadvertently pulled a selection knob 17 on a lower cost pack 13 of cigarettes, the totalizer unit 10 would allow such a selection but would not return any of the additional coin currency deposited in the machine 9.

As thus described, it should be clear that the initial movement of any one of the selection knobs 17 will cause rotation of the actuation shaft 40 and actuation cam 42. With proper movement in the clockwise direction, any one of the release latches 30, 32, 34 and corresponding release means may be moved to the release position to allow continued movement of the selected knob 17 if the proper amount of coin currency has been deposited in the mechanical totalizer unit 10. Assuming a proper amount of coin currency has been deposited in the coin chute assembly 12 and that the purchaser has selected a proper pack 13 of cigarettes for disposition from the machine 9, the release of the selection knob 17 will cause the actuation shaft 40 and the actuation cam 42 to be rotated in the counter-clockwise direction to be returned to the position as shown in FIG. 4.

Throughout rotational movement of the actuation shaft 40 and actuation cam 42, the rotation of the cam slot 44 has produced movement of a reset lever 62. The reset lever 62 is mounted for rotation about a pivot 64 and includes a reset roller 66 which extends into the cam slot 44. The initial movement of the actuation cam 42 in a clockwise direction causes the reset roller 66 in the cam slot 44 to pivot the reset lever 62 in a clockwise direction about the pivot 64. The extended end 68 of the reset lever 62 is coupled to reset linkage 70 which extends toward the coin recorder mechanism 14. When the reset linkage 70 is moved upward with the pulling of a selection knob 17, it is configured, upon returning to the non-selected position, to cause a resetting of the coin recorder mechanism 14 to the "zero" position. With the ratchet wheel and discs therein returned to the "zero" position, the coin recorder mechanism 14 will be returned to a condition as if no coin currency had been deposited in the mechanical totalizer unit 10. As the particular selection knob 17 is released by the purchaser, the rotation of the actuation cam 42 to the position shown in FIG. 4, causes a resetting of the coin recorder mechanism 14 through the counter-clockwise rotation of the reset lever 62 and downward movement of the reset linkage 70.

As thus described, the operation of the totalizer unit 10 allows proper selection of a pack 13 of cigarettes by a purchaser after a proper amount of coin currency has been deposited in the coin slot 15. However, the totalizer unit 10 includes another feature if the purchaser deposits coin currency in the cigarette vending machine 9 and then determines that no selection is desired. Below the coin chute assembly 12 is a pair of doors 71, 72 which are pivotally supported at a separating wall 73 and include extended ends which are respectively aligned with the lower walls 75. The doors 71, 72 combine to retain therebetween all of the coin currency deposited through the coin chute assembly 12 until one of two events occurs. If a purchaser determines that no selection should be made, the coin rejection lever 21 on the front of the cigarette vending machine 9 can be pulled downwardly to lower coin door 71. As a result, coin currency collected between the doors 71, 72 will be directed forwardly to the return chute 74 and ejected from the cigarette vending machine to the tray 19 for recollection by the purchaser. On the other hand, if a proper selection is made through the pulling and release of the selection knob 17, the coin door 72 will be lowered to allow the coin currency collected between the coin doors 71, 72 to be directed to a collection chute 76 and a coin collection box (not shown) therebelow.

Figure 5:
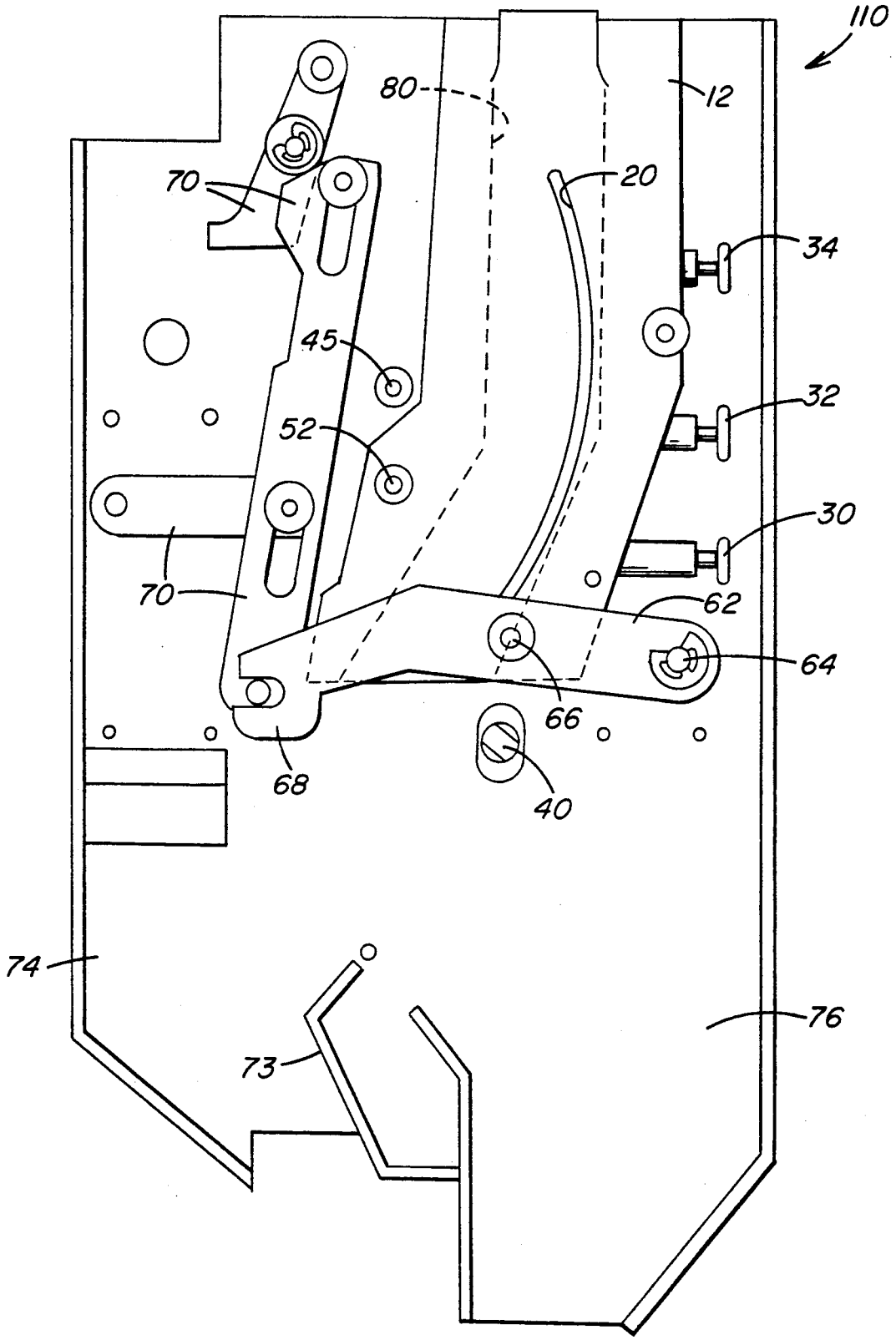
FIG. 5 PRIOR ART
FIG. 5 is a modified totalizer unit of the prior art which has been adapted for use in conjunction with the preferred paper and coin currency totalizer of the present invention.

As seen in FIG. 5, the basic mechanical totalizer unit 10 has been altered to provide a modified totalizer unit 110 by the removal of certain components therefrom and the retention of other components therein for use in conjunction with the preferred paper and coin currency totalizer system 41 for the disposition of packs 13 of cigarettes from the existing cigarette vending machine 9 which includes the existing mechanical dispensing mechanism.

Specifically, the coin recorder mechanism 14 and trip wire 16 with its extended finger 18 have been removed from the modified totalizer unit 110. Additionally, the three latch release bars 22 and associated connecting elements 28 to the release latches 30, 32, 34 have been removed. Consequently, the three release latches 30, 32, 34 are positioned in a "non-released" position with the respective release means (not shown) in a position to prevent movement of any of the selection knobs 17. With the actuation cam 42 temporarily removed from the actuation shaft 40, the release arm 50, spring 60 and springs 56 which previously extended to the first ends 24 of the latch release bars 20 are also removed from the totalizer unit 10. Still further, the two coin doors 71, 72 and the lower walls 75 have also been removed from the totalizer unit 10 to complete the formation of the modified totalizer unit 110.

Removal of the coin recorder mechanism 14, trip wire 16, latch release bars 22, connecting elements 28, release arm 50, springs 56 and 60, doors 71 and 72, and lower walls 75 is simple and within the capability of the owner-operator. The removal is accomplished with simple hand tools by the removal of mounting screws and/or bolts. None of the components which are removed from the modified totalizer unit 110 are welded or secured in place to prevent their simple, convenient removal by those skilled in the vending machine art.

It is significant to note that the coin chute assembly 12, which is quite difficult to remove, is retained in the modified totalizer unit 110 although only the quarter chute 80 will eventually be used. The nickel and dime chutes will not be employed because, with the new means of utilizing both paper and coin currency in the preferred paper and coin totalizer system 41 for the vending of cigarettes, only quarters would be employed. Consequently, with a proper adjustment of the coin selector and slug rejecter device (not shown) above the modified totalizer unit 110, only quarters will be advanced to the coin chute assembly 12 for passage through the quarter chute 80. Also remaining in the modified totalizer unit 110 are the reset lever 62 and associated reset linkage 70. Although, as will be seen, the reset linkage 70 and movement thereof is not essential to the operation of the modified totalizer unit 110, the reset lever 62 will be employed.

As seen in FIG. 6, the modified totalizer unit 110 has been employed for the desired modification of the vending machine 9 to operate in conjunction with the preferred paper and coin currency totalizer system 41 of the present invention. Specifically, the remaining components thereof are necessary for determining if a proper number of quarters have been deposited in the cigarette vending machine 9, for producing the desired movement of the release means (not shown) which will allow the selection knob 17 to be pulled for the dispensing of the selected pack 13 of cigarettes, and for mechanically determining when a selection has been made.

The modified totalizer unit 110 is configured to include a modification support framing 112 which is installed in the totalizer unit 10 in the area of the doors 71, 72 and lower walls 75. The support framing 112 includes mounting screws or the like which can, for example, be aligned with existing threaded holes for the lower walls 75 removed from the modified totalizer unit 110 for simple installation therein. After the support framing 112 is installed in the modified totalizer unit 110, the actuation cam 42 can be reinstalled on the actuation shaft 40. The modification support framing 112 includes four major components which are configured to function with the existing components remaining within the modified totalizer unit 110.

A quarter chute extension 114 of the modification support framing 112 is aligned with the lower end of the quarter chute 80 to cause each quarter passing therethrough to be properly oriented for passage through the quarter chute extension 114. After a quarter has passed through the quarter chute extension 114, it is further directed to the right, as seen in FIG. 6, through the collection chute 76 for collection in the coin collection box (not shown) therebelow.

However, as the quarter passes through the quarter chute extension 114, it is maintained in alignment for passage by the coin currency sensor 115 of the totalizer system 41. The preferred coin currency sensor 115 is a optic device 116 which is capable of determining the movement of each quarter passing thereby. The optic device 116 senses each quarter and provides a signal through first wiring 144, to be discussed hereinbelow, for transmitting a coin signal to the currency totalizer control means 37 of the preferred totalizer system 41. The total amount of coin currency passing by the optic device 116 can be electronically combined in the currency totalizer control means 37, and printed circuit board thereof, with a paper signal indicative of the paper currency deposited in the paper currency verification and sensing means 39 for determining if a total amount of currency has been properly deposited in the paper slot 33 of the attached box 25 and/or directly into the coin slot 15 of the cigarette vending machine 9. The current amount of the currency deposited in the slots 15, 33 will be shown on the currency display 35 at the front of the box 25.

After the proper amount of coin and paper currency has been deposited in the cigarette vending machine 9 and/or box 25, the printed circuit board of the currency totalizer control means 37 indicates the proper amount on the currency display 35 to confirm the proper deposit of currency and produces a desired actuation signal indicating that a selection can be made by the purchaser. When the purchaser has deposited a proper amount of paper and/or coin currency, a selection can be made by using the same existing mechanical dispensing mechanism in the cigarette vending machine 9 as discussed hereinabove. Initial movement of a selection knob 17 will cause a lifting of the reset lever 62 by the rotation of the actuation cam 42. However, while the actuation cam 42 in the totalizer unit 10, prior to the modification, caused movement of the release arm 50 and the various latch release bars 22, their removal would prevent this means for providing downward movement of the release latches 30, 32, or 34 to position the release means to the release position.

Instead, the modified totalizer unit 110 includes a entirely different actuation means 119 of the preferred totalizer system 41 in the form of a release solenoid 120 having a release connection 122 extending to the release latch 30. The release solenoid 120 is mounted on the support framing 112 prior to its installation within the modified totalizer unit 110. No connection means is provided for the release latch 32 or the release latch 34. Consequently, for the cigarette vending machine 9 which is modified by the preferred system 41 for accepting paper and/or coin currency for the dispensing of packs 13 of cigarettes, all of the packs 13 of cigarettes stored therein will be similarly priced so that the same amount of money will be required for each pack 13 therein. As a result, the mechanical dispensing mechanism in the cigarette vending machine 9 will be configured so that all of the selection knobs 17, when being pulled, will be prevented from actually dispensing a pack 13 of cigarettes if the single release means (not shown) associated with the release latch 30 has not been moved to the release position. The modification or configuration of the mechanical dispensing mechanism to only allow movement of particular selection knobs 17 if the release means is in the release position has been well known to those skilled in the vending machine art prior to any modification of the machines 9 by the present invention and would be the same after the modification of the machine 9 to operate in conjunction with the preferred system 41. As a result, when the release latch 30 has been moved by the actuation of the release solenoid 120 by the actuation signal from the currency totalizer control means 37 and downward movement of the release connection 122, the movement of its associated release means to the release position will allow any of the selection knobs 17 to be pulled to a sufficient extent that the selected pack 13 of cigarettes can be dispensed.

If a proper amount of paper and/or coin currency has been deposited and a proper selection has been made by the purchaser pulling a selection knob 17, the selection knob 17 will be released for return to the non-selected position. Upon the release of the selection knob 17, the actuation shaft 40 and actuation cam 42 will return to the position as shown in FIGS. 4 and 6. With the reset lever 62 having been rotated in a clockwise direction and then in a counter-clockwise direction about pivot 64, the upward and downward movement thereof is indicative of one of the selection knobs 17 having been pulled. Accordingly, the preferred currency totalizer control means 37 operates in conjunction with the preferred reset sensor 129 which is configured to sense such a physical movement in the modified totalizer unit 110. The preferred reset sensor 129, in the form of a reset switch 130, which is also mounted on the modification support framing 112, is positioned to sense the movement of the reset lever 62. As the reset lever 62 moves clockwise away from the reset switch 130, the movement is sensed by the reset switch 130 and, upon return to the position as shown in FIG. 6, the reset switch 130 provides a reset signal to the currency totalizer control means 37 to indicate a selection has been made and that no currency has yet been received for the next selection.

Also associated with the modification support framing 112 is a wiring harness 140 as shown in FIGS. 3 and 6. The wiring harness 140 has an end coupling 142 thereon for easy connection to the corresponding wiring harness 29 from the printed circuit board of the currency totalizer control means 37 in the box 25. The wiring harness 140 includes the first wiring 144 for coupling the printed circuit board to the quarter optic device 116 for the transmission of the coin signal therefrom. Similarly, second wiring 146 connects the printed circuit board to the release solenoid 120 for the transmission of the actuation signal to cause movement of the release connection 122 and release latch 30 for movement of the release means to the release position. Finally, third wiring 148 connects the reset switch 130 to the printed circuit board for indication that a selection has been made and the entire printed circuit board is to be returned to the "zero" condition to require additional paper and/or coin currency to be deposited therein for the next selection of a pack of cigarettes.

As thus described, the preferred paper and coin currency totalizer of the present invention can be easily installed on existing cigarette vending machines by the modification of the mechanical coin totalizer units thereof and the addition of the attached box including a paper currency verification and sensing means and a preferred currency totalizer control means. While it should be clear from the description provided hereinabove that the preferred paper and coin currency totalizer system 41 is intended to be capable of receiving both coin currency through the slot 15 and paper currency through the slot 33, the actual amount of the currency required can be selectively varied. The preferred currency totalizer control means includes the printed circuit board described hereinabove having a capability of totalizing an amount of currency from \$0.25 to \$7.75. The actual amount of the total currency needed to dispense a pack of cigarettes is determined, for example, by the setting of various selection switches incorporated in the printed circuit board providing the currency totalizer control means. Such electronic means for selectively varying the total amount of currency required are well known within the vending machine art and well within the capability of those designing such electronic control means for various vending machines utilized throughout the vending machine field.

While the preferred paper and coin currency totalizer system is intended to be employed in conjunction with specific mechanical totalizer units and mechanical dispensing mechanisms found in existing cigarette vending machines produced by National Vendors, Inc., it should be recognized that the basic invention disclosed herein could be utilized in other similar vending machine configurations for a convenient and reliable modification thereof while utilizing existing components therein. Accordingly, while the preferred embodiment of the present invention is directed to the particular models of well-known cigarette vending machines which have been extensively used in the cigarette vending field, the invention as claimed could be employed in other vending machines including similar mechanical components and features. Further, it should be clear that while the present invention is defined in general terms of the preferred embodiment disclosed herein, other alterations and modifications could be made without departing from the scope of the invention as claimed.

What is claimed is:

1. The improved paper and coin currency totalizer for being installed on an existing vending machine of the type having an existing totalizer unit which includes an existing coin receiving channel, an existing movable mechanical release means for being moved to a release position to allow an item in the existing vending machine to be dispensed, and an existing movable mechanical reset means which is for being moved to a reset position after the item is dispensed, said improved paper and coin currency totalizer comprising:

an electronic coin currency sensor mounted in the existing totalizer unit in alignment with the coin receiving channel;

said electronic coin currency sensor for producing a coin signal when a coin currency passes through the coin receiving channel and by said electronic coin currency sensor;

an electronic paper currency sensor for producing a paper signal when a paper currency is deposited in and verified by said electronic paper currency sensor;

currency totalizer control means for receiving each said paper signal from said electronic paper currency sensor and each said coin signal from said electronic coin currency sensor;

said currency totalizer control means including currency amount means for determining by a total of said paper signals and said coin signals when a predetermined amount of currency has been deposited in said electronic paper currency sensor and through the coin receiving channel;

actuation means mounted in the existing totalizer unit for moving the mechanical release means in the existing totalizer unit to the release position;

said currency totalizer control means including actuation signal means for sending an actuation signal to said actuation means from said currency amount means when said predetermined amount of currency has been deposited in said electronic paper currency sensor and through the coin receiving channel;

a reset sensor mounted in the existing totalizer unit in alignment with the movable mechanical reset means for producing a reset signal when the movable mechanical reset means is moved to the reset position;

said currency totalizer control means for receiving said reset signal and for discontinuing said actuation signal to the actuation means when said reset signal is received from said reset sensor;

said currency totalizer control means including variable selection means for selectively varying said predetermined amount of currency needed to produce said actuation signal by said currency amount means;

said electronic coin currency sensor, said actuation means, and said reset sensor being mounted on a support plate which is installed within the existing totalizer unit;

a housing secured to an outside wall of the existing vending machine; and said electronic paper currency sensor and said currency totalizer control means being mounted within said housing.

2. The improved paper and coin currency totalizer according to claim 1, wherein said currency totalizer control means includes currency display means indicating an amount of currency corresponding to said total of said paper signals and said coin signals and said currency display means is mounted at a front of said housing.

3. The improved paper and coin currency totalizer according to claim 1, further including first electrical wiring, second electrical wiring and third electrical wiring between the existing totalizer unit and said housing, said first electrical wiring operably connecting said electronic coin currency sensor and said currency totalizer control means for providing said coin signal, said second electrical wiring operably connecting said currency totalizer control means and said actuation means for providing said actuation signal, and said third electrical wiring operably connecting said currency totalizer control means and said reset sensor for providing said reset signal.

4. The improved paper and coin currency totalizer according to claim 3, wherein the coin receiving channel is configured for passing a quarter therethrough, said electronic coin currency sensor provides said coin signal for each said quarter passing thereby, said electronic paper currency sensor is configured to receive and verify at least a one dollar bill passing therethrough, said electronic paper currency sensor provides said paper signal for each said at least one dollar bill passing therethrough, and said predetermined amount of currency of said currency amount means is established by an electronic summation of said paper signals and said coin signals respectively from said electronic paper currency sensor and said electronic coin currency sensor.

5. The improved paper and coin currency totalizer according to claim 4, wherein said variable selection means can be for selectively varying, at one quarter increments, said predetermined amount of currency ranging from $0.25 to $7.75.

6. The improved paper and coin currency totalizer for being installed on an existing vending machine of the type having an existing totalizer unit which includes an existing coin receiving channel, an existing movable mechanical release means for being moved to a release position to allow an item in the existing vending machine to be dispensed, and an existing movable mechanical reset means which is for being moved to a reset position after the item is dispensed, said improved paper and coin currency totalizer comprising:

a housing mounted on an outside wall of the existing vending machine;

an electronic paper currency sensor and a currency totalizer control means mounted within said housing;

an electronic coin currency sensor mounted in the existing totalizer unit in alignment with the coin receiving channel;

said electronic coin currency sensor for producing a coin signal when a coin currency passes through the coin receiving channel and by said electronic coin currency sensor;

said electronic paper currency sensor for producing a paper signal when a paper currency is deposited in and verified by said electronic paper currency sensor;

said currency totalizer control means for receiving each said paper signal from said electronic paper currency sensor and each said coin signal from said electronic coin currency sensor;

said currency totalizer control means including currency amount means for determining by a total of said paper signals and said coin signals when a predetermined amount of currency has been deposited in said electronic paper currency sensor and through the coin receiving channel;

actuation means mounted in the existing totalizer unit for moving the mechanical release means in the existing totalizer unit to the release position;

said currency totalizer control means including actuation signal means for sending an actuation signal to said actuation means from said currency amount means when said predetermined amount of currency has been deposited in said electronic paper currency sensor and through the coin receiving channel;

a reset sensor mounted in the existing totalizer unit in alignment with the movable mechanical reset means for producing a reset signal when the movable mechanical reset means is moved to the reset position; and said currency totalizer control means for receiving said reset signal and for discontinuing said actuation signal to the actuation means when said reset signal is received from said reset sensor.

7. The improved paper and coin currency totalizer according to claim 6, wherein said electronic coin currency sensor, said actuation means, and said reset sensor are mounted on a support plate which is installed within the existing totalizer unit.

8. The improved paper and coin currency totalizer according to claim 7, wherein said currency totalizer control means includes variable selection means for selectively varying said predetermined amount of currency needed to produce said actuation signal by said currency amount means.

9. The improved paper and coin currency totalizer according to claim 7, wherein said currency totalizer control means includes currency display means indicating an amount of currency corresponding to said total of said paper signals and said coin signals and said currency display means is mounted at a front of said housing.

10. The improved paper and coin currency totalizer according to claim 7, further including first electrical wiring, second electrical wiring and third electrical wiring between the existing totalizer unit and said housing, said first electrical wiring operably connecting said electronic coin currency sensor and said currency totalizer control means for providing said coin signal, said second electrical wiring operably connecting said currency totalizer control means and said actuation means for providing said actuation signal, and said third electrical wiring operably connecting said currency totalizer control means and said reset sensor for providing said reset signal.

11. The improved paper and coin currency totalizer according to claim 10, wherein the coin receiving channel is configured for passing a quarter therethrough, said electronic coin currency sensor provides said coin signal for each said quarter passing thereby, said electronic paper currency sensor is configured to receive and verify at least a one dollar bill passing therethrough, said electronic paper currency sensor provides said paper signal for each said at least one dollar bill passing therethrough, and said predetermined amount of currency of said currency amount means is established by an electronic summation of said paper signals and said coin signals respectively from said electronic paper currency sensor and said electronic coin currency sensor.

12. A method of converting an existing vending machine to enable paper currency and coin currency to be used to allow an item in the existing vending machine to be dispensed therefrom; the existing vending machine being of the type which is coin operated and has an existing totalizer unit which includes a plurality of coin receiving channels, coin sensing means for sensing when coin currency is deposited in the plurality of coin receiving channels, totalizer means for totaling the coin currency passing through the plurality of coin receiving channels as sensed by the coin sensing means and for determining when a predetermined total of the coin currency has been deposited therein, movable mechanical release means for being moved to a release position to allow the item to be dispensed, first actuation means operably controlled by the totalizer means when the first predetermined total of the coin currency has been deposited in the plurality of coin receiving channels for moving the movable mechanical release means to the release position, movable mechanical reset means for movement to a reset position to reset the totalizer means and to move the movable mechanical release means away from the release position after the item is dispensed; said method comprising the steps of:

removing the coin sensing means;

removing the totalizer means;

removing the first actuation means;

securing a housing to the existing vending machine;

providing currency totalizing control means within said housing, said currency totalizing control circuit including a currency adding means;

installing an electronic coin currency sensor in the existing totalizer unit in alignment with a first coin receiving channel of the plurality for sensing the coin currency passing thereby;

installing a second actuation means in the existing totalizer unit for being actuated to move the movable mechanical release means to the release position;

installing a reset sensor in the existing totalizer unit in alignment with the movable mechanical reset means when moved to the reset position;

providing an electronic paper currency sensor within said housing for sensing the paper currency passing therethrough;

operably connecting said currency totalizing control means to said electronic coin currency sensor and said electronic paper currency sensor for determining through the currency adding means when a predetermined total currency is sensed by said electronic coin currency sensor and said electronic paper currency sensor;

operably connecting said currency totalizing control means to said second actuation means for actuation thereof when said predetermined total currency is determined by said currency adding means; and operably connecting said currency totalizing control means to said reset sensor, said currency totalizing control means for being reset and for discontinuing actuation of said second actuation means when the movable mechanical reset means is moved to the reset position as sensed by said reset sensor.

13. The method of converting the existing vending machine according to claim 12, further including the step of providing a currency display means on said housing for indicating a current total currency sensed by said electronic coin sensor and said electronic paper currency sensor prior to the item being dispensed from the existing vending machine.

14. The method of converting the existing vending machine according to claim 12, wherein the existing totalizer unit includes retaining means for temporarily retaining the coin currency below the plurality of coin receiving channels, further including the step of removing the retaining means for the existing totalizer unit and said installing of said electronic coin currency sensor is in a region of the existing vending machine below the first coin receiving channel.

15. The method of converting the existing vending machine according to claim 14; wherein the existing totalizer unit includes internal wall means cooperating with said retaining means; further including the steps of removing said internal wall means; providing a support plate having said electronic coin currency sensor, second actuation means and said reset sensor mounted thereon; and mounting said support plate within the existing totalizer unit.

* * * * *